US011723423B2

(12) United States Patent
Blevins

(10) Patent No.: US 11,723,423 B2
(45) Date of Patent: Aug. 15, 2023

(54) HOODIE WITH INTEGRATED HEADPHONE APERTURES

(71) Applicant: Ninja Holdings, LLC, Chicago, IL (US)

(72) Inventor: Richard Tyler Blevins, Los Angeles, CA (US)

(73) Assignee: Ninja Holdings, LLC, Chicago, IL (US)

( * ) Notice: Subject to any disclaimer, the term of this patent is extended or adjusted under 35 U.S.C. 154(b) by 0 days.

(21) Appl. No.: 16/882,164

(22) Filed: May 22, 2020

(65) Prior Publication Data

US 2021/0361008 A1 Nov. 25, 2021

(51) Int. Cl.
*A41D 31/02* (2019.01)
*A42B 1/04* (2021.01)

(52) U.S. Cl.
CPC ..... *A41D 31/02* (2013.01); *A42B 1/04* (2013.01); *A41D 2200/20* (2013.01)

(58) Field of Classification Search
CPC ..... A41D 2200/20; A41D 1/04; A41D 23/00; A41D 2300/322; A41D 31/02; A41D 31/04; A41D 1/002; A41D 1/005; A41D 13/0002; A41D 13/05; A41D 15/00; A41D 20/00; A41D 2300/22; A41D 2300/32; A41D 2400/10; A41D 2600/10; A41D 27/02; A41D 27/10; A41D 27/205; A41D 27/28; A41D 3/00; A41D 3/08; A41D 31/145; A42B 1/048; A42B 1/046; A42B 1/006; A42B 1/008; A42B 1/0188; A42B 1/041; A42B 1/045; A42B 1/225; A42B 3/105; A42B 3/166; A42B 1/245; H04R 5/0335;

(Continued)

(56) References Cited

U.S. PATENT DOCUMENTS 3,706,102 A 12/1972 Grenier
5,109,549 A 5/1992 Mattinson
(Continued)

FOREIGN PATENT DOCUMENTS

KR 20120002764 U * 4/2012
KR 200486717 Y1 * 6/2018 ..... A41D 3/02

OTHER PUBLICATIONS

International Search Report and Written Opinion for App. No. PCT/US21/33581, dated Aug. 16, 2021, 15 pages.
(Continued)

*Primary Examiner* — Katherine M Moran
*Assistant Examiner* — Grady Alexander Nunnery
(74) *Attorney, Agent, or Firm* — Loeb & Loeb LLP

(57) ABSTRACT

A hood for a hooded garment may include apertures in the hood to improve a sealing connection between headphone earpieces and the outer portion of the user's ears while using headphones while also maintaining the hood's ability to retain body heat when not using headphones. While using the hood with headphones, the apertures may improve the sealing connection between the headphone earpieces and the user's ears and, thus, improve the function of the headphones (e.g., sound translation or sound deadening). While using the hood without headphones, a portion of mesh fabric sewn into the hood over the apertures allows the hood to retain the user's body heat and thereby mitigate heat loss through the hood caused by the apertures.

7 Claims, 6 Drawing Sheets

(58) Field of Classification Search
CPC . H04R 1/1008; H04R 1/023; H04R 2201/023
See application file for complete search history.

(56) References Cited

U.S. PATENT DOCUMENTS

| | | | | |
|---|---|---|---|---|
| 5,153,945 | A | 10/1992 | Kobayashi | |
| 5,881,389 | A * | 3/1999 | Fruge | A42B 1/046 2/202 |
| 8,474,064 | B2 * | 7/2013 | Hardy, III | A42B 3/16 2/209 |
| D736,496 | S | 8/2015 | Gonzalez | |
| D758,699 | S | 6/2016 | Darmour | |
| D793,034 | S | 8/2017 | Holder | |
| D874,094 | S | 2/2020 | Carey | |
| D903,238 | S | 12/2020 | Park | |
| 2011/0004971 | A1 * | 1/2011 | Benderradji | A42B 1/048 2/84 |
| 2011/0209265 | A1 * | 9/2011 | Komada | A42B 1/048 2/202 |
| 2013/0177165 | A1 * | 7/2013 | Oishi | H04R 1/105 381/74 |
| 2014/0338092 | A1 * | 11/2014 | Kinsey | A42B 1/048 2/84 |
| 2019/0014842 | A1 * | 1/2019 | Israel | A61F 11/14 |
| 2020/0120996 | A1 * | 4/2020 | Wilson | A41D 1/04 |
| 2022/0168135 | A1 | 6/2022 | Huang | |
| 2023/0131245 | A1 | 4/2023 | Larocca | |

OTHER PUBLICATIONS

International Preliminary Report on Patentability issued in App. No. PCT/US2021/033581, dated Nov. 17, 2022, 7 pages.

Gildan mens Pullover, posted Jan. 25, 2018 [online], (retrieved May 3, 2023). Retrieved from the internet, https://www.amazon.com/Gildan-mens-Pullover/dp/B0799Y29GM?th=1(Year: 2018).

Notice of Allowance dated May 18, 2023 for corresponding U.S. Appl. No. 29/770,096, (pp. 1-9).

* cited by examiner

HOODIE WITH INTEGRATED HEADPHONE APERTURES

CROSS-REFERENCE TO RELATED APPLICATIONS

This application is related to U.S. patent application Ser. No. 29/735,724, filed on May 22, 2020 and entitled "Hooded Sweatshirt," which is incorporated by reference herein in its entirety.

BACKGROUND

The background description provided herein is for the purpose of generally presenting the context of the disclosure. The work of the presently named inventors, to the extent it is described in this background section, as well as aspects of the description that may not otherwise qualify as prior art at the time of filing, are neither expressly nor impliedly admitted as prior art against the present disclosure.

A head covering such as a hat or hood is often employed to mitigate the user's discomfort in cold external temperatures. For example, with a hooded sweatshirt or "hoodie," the user may substantially cover his or her head to contain body heat that is typically lost. Used in this way, a hoodie may provide adequate head covering to retain the user's body heat and maintain user comfort. The hoodie garment may be especially convenient for the user to retain body heat since the hood or head covering portion of the garment is integrated into the body portion of the garment.

While the hoodie is useful to maintain user comfort, its use may also be detrimental to the user's comfort or practical use in certain situations. For example, because the hood fabric often fits snugly against the user's ears, the user's ability to hear may be reduced. Further, the user's ability to use headphones for either sound enhancement or deadening is often diminished either because the interior space between the hood and the user's ears cannot accommodate headphones comfortably or, if worn over the hood, the hood fabric muffles and greatly reduces the sound translation from the headphones to the user's ears or interferes with forming an adequate seal to reduce sound translation.

SUMMARY

The following presents a simplified summary of the present disclosure in order to provide a basic understanding of some aspects of the disclosure. This summary is not an extensive overview. It is not intended to identify key or critical elements of the disclosure or to delineate its scope. The following summary merely presents some concepts in a simplified form as a prelude to the more detailed description provided below.

The disclosure presents practical applications to hooded garment design by providing apertures in the hood to improve a sealing connection between the headphone earpieces and the outer portion of the user's ears while using headphones while also maintaining the hood's ability to retain body heat when not using headphones. While using the hood with headphones, the apertures improve the sealing connection between the headphone earpieces and the user's ears and, thus, improve the function of the headphones (e.g., sound translation or sound deadening). While using the hood without headphones, a portion of mesh fabric sewn into the hood over the apertures allows the hood to retain the user's body heat when the hood is "up" or substantially covers the user's head. In some embodiments, the mesh or perforated fabric portion may be one or more plies of fabric having perforations of uniform or varying size. The fabric plies and/or perforations within the material may be positioned over the user's ears in various configurations to optimize both headphone fit and performance and user comfort.

In some embodiments, the hoodie may include a hood configured to extend upward from a neck region, the hood including a crown and a face opening area. The face opening area may be defined by a first side panel and a second side panel. The first side panel may be opposed to the second side panel, and the first and second side panels may extend upward from the neck region and join at the crown. A headphone earpiece aperture formed on at least one of the first and second side panels may be positioned on the at least one of the first and second side panels to substantially cover an outer ear portion of a user when the hood covers the user's head. An aperture covering within the headphone aperture includes a plurality of perforations to allow sound translation/canceling through the apertures while maintaining heat retention when headphones are not in use.

In further embodiments, the hoodie may include a shirt having a hood extending upward from a neck region to a crown. The hood may have an inner lining material and an outer hood material, forming adjacent layers, and a face opening area defined by a hem of the adjacent layers. A first headphone aperture and a second headphone aperture may both extend through the inner lining material and the outer hood material on opposing sides of the hood. A first aperture covering may be within the first headphone aperture and a second aperture covering may be within the second headphone aperture. The first aperture covering and the second aperture covering both include a plurality of perforations, and when the hood covers the user's head, the first headphone aperture substantially covers a first ear of a user and the second headphone aperture substantially covers a second ear of the user. Thus, sound may be translated/canceled through the apertures while heat is retained when headphones are not in use.

BRIEF DESCRIPTION OF THE DRAWINGS

The figures depict a preferred embodiment for purposes of illustration only. One skilled in the art may readily recognize from the following discussion that alternative embodiments of the structures and methods illustrated herein may be employed without departing from the principles described herein.

DETAILED DESCRIPTION

The present application describes embodiments including various elements that are present in a hooded garment. These elements are not an exhaustive collection of all elements needed for a hooded garment or the disclosed embodiments. Indeed, the elements associated with the hooded garment described in this application are only some of the possible elements that are needed to implement the embodiments. Some embodiments may include more or fewer elements than those that are described with the embodiments, as known by a person having ordinary skill in the art of garment design and manufacture.

The disclosure presents practical applications to hooded garment design by describing a hood for a garment with integrated headphone apertures. The apertures in the hood improve the sealing connection between the user's ears and the headphone earpieces and also improve the flow of sound from headphones worn over the hood to the user's ears. A portion of mesh fabric with a plurality of perforations may replace a portion of hood fabric that is positioned over the user's ears when the hood is "up" or substantially covers the user's head. In some embodiments, the perforated fabric portion may be one or more plies of fabric having perforations of uniform or varying size. The fabric plies and/or perforations within the aperture covering material may be positioned over the user's ears in various configurations to optimize both sound translation and sound deadening as well as user comfort.

While an embodiment provides a hoodie sweatshirt having an integral or detachable hood portion and sweatshirt portion, the hood may also be a modular component available for attachment to other compatible garments. Further, because the hood and integrated headphone apertures may become soiled from use, interchangeable hoods, apertures, and sweatshirts may be provided.

Figure 1:
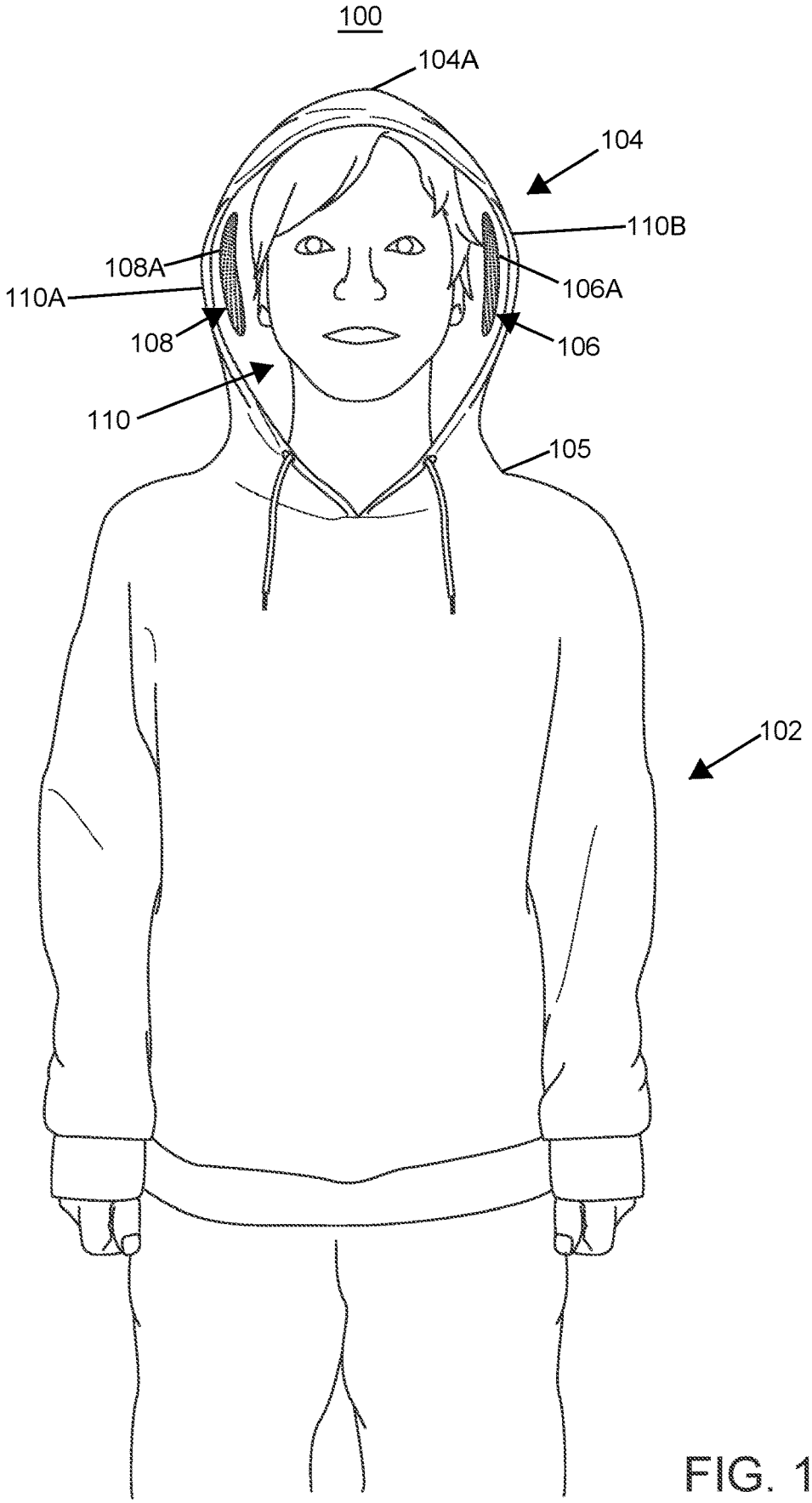
FIG. 1 is a front view illustration of a hooded article of clothing in accordance with the current disclosure.

FIG. 1 generally illustrates a front view of one embodiment of a hoodie sweatshirt 100 having a body portion 102 and a hood portion 104. The hood 104 may extend upward from a neck region 105 of the sweatshirt 100. The hood 104 may include a crown 104A and a face opening area 110. The face opening area 110 may be defined by a first side panel 110A that is opposite to a second side panel 1106. The first and second side panels may extend upward from the neck region and join at the crown. In some embodiments, the first side panel 110A and the second side panel 1106 are separate pieces of fabric joined by a seam or hem at the crown 104A. In further embodiments, the first and second side panels 110A, 1106 are a single piece of continuous fabric that extends from the neck region 105 to the crown 104A.

The hood portion 104 includes at least one headphone aperture 106, 108. Each headphone aperture 106, 108 is positioned on the hood portion 104 to substantially cover each ear of the user when the hood portion 104 is employed by the user to cover his or her head. While the embodiments of this disclosure show the hood portion 104 including at least two headphone apertures 106, 108, some embodiments may include a single headphone aperture 106 to accommodate single-earpiece headphones, microphones, or other equipment.

Figure 2:
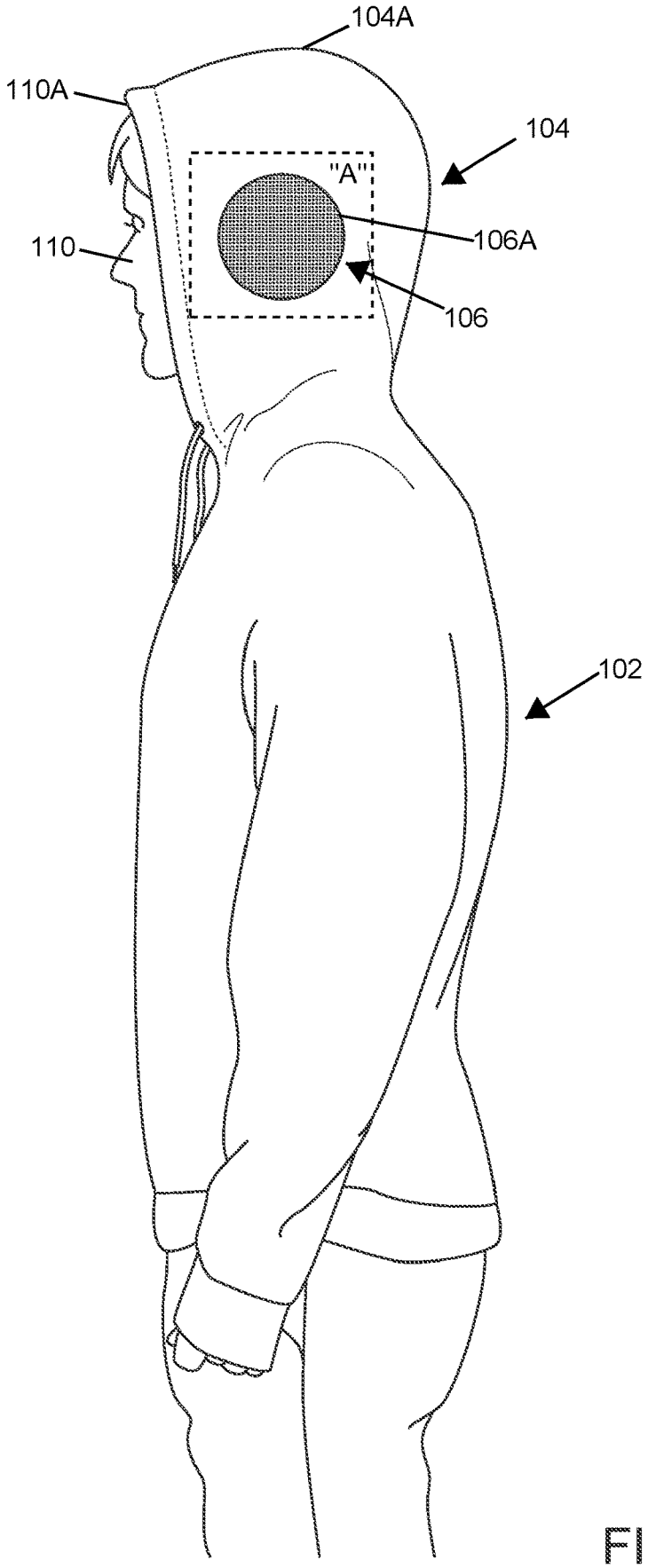
FIG. 2 is a side view illustration of a hooded article of clothing in accordance with the current disclosure.
Figure 3:
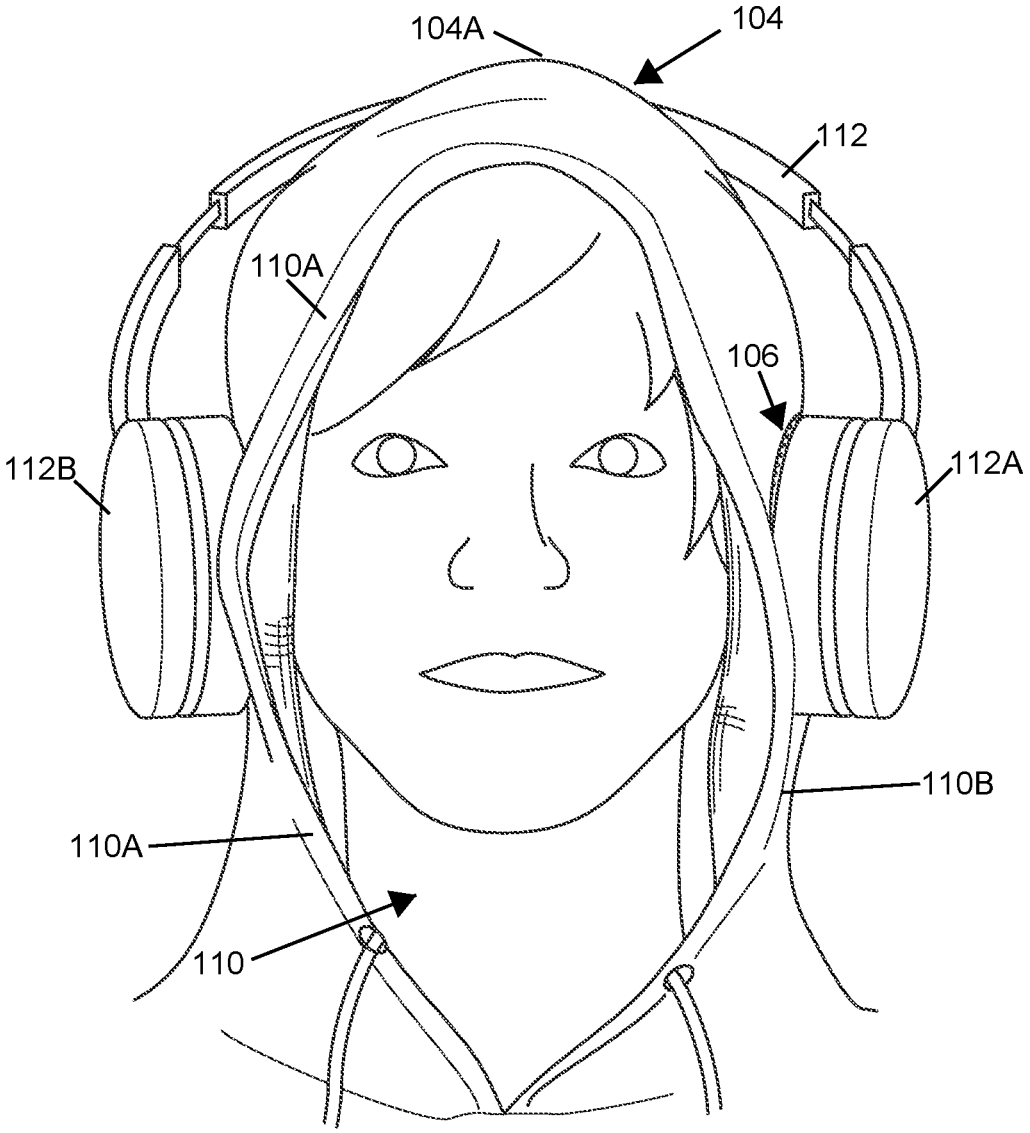
FIG. 3 is another front view illustration of a hooded article of clothing in accordance with the current disclosure.

The hood portion 104 may be integral to the body portion 102 or may be selectively detachable from or affixed to the body portion 102 by any number of known methods (e.g., slide fastener, snap fastener, button, etc.). With reference to FIGS. 2 and 3, the aperture portions 106 and 108 (FIG. 1) may be positioned on the sides of the hood portion 104 and substantially over the user's ears when the hood is up. In some embodiments, the apertures 106, 108 may be about the same size as the headphone earpieces 112A, 112B (FIG. 3) of the headphones 112. For example, the apertures 106, 108 may be about three to five inches in diameter and positioned within an area "A" (FIG. 2) on the hood portion 104. In some embodiments, the area "A" may be positioned within about ten inches from the top or crown 104A of the hood portion 104 and within about three inches from the face opening hem 110A surrounding the face opening area 110 of the hood portion 104. In further embodiments, an outer edge 106A, 108A of the aperture portions 106, 108 may be positioned on the sides of the hood portion 104 approximately seven and one-quarter inches down from the center of the crown 104A of the hood portion 104 and approximately two and three-quarters inches from the face opening hem 110A.

Figure 4:
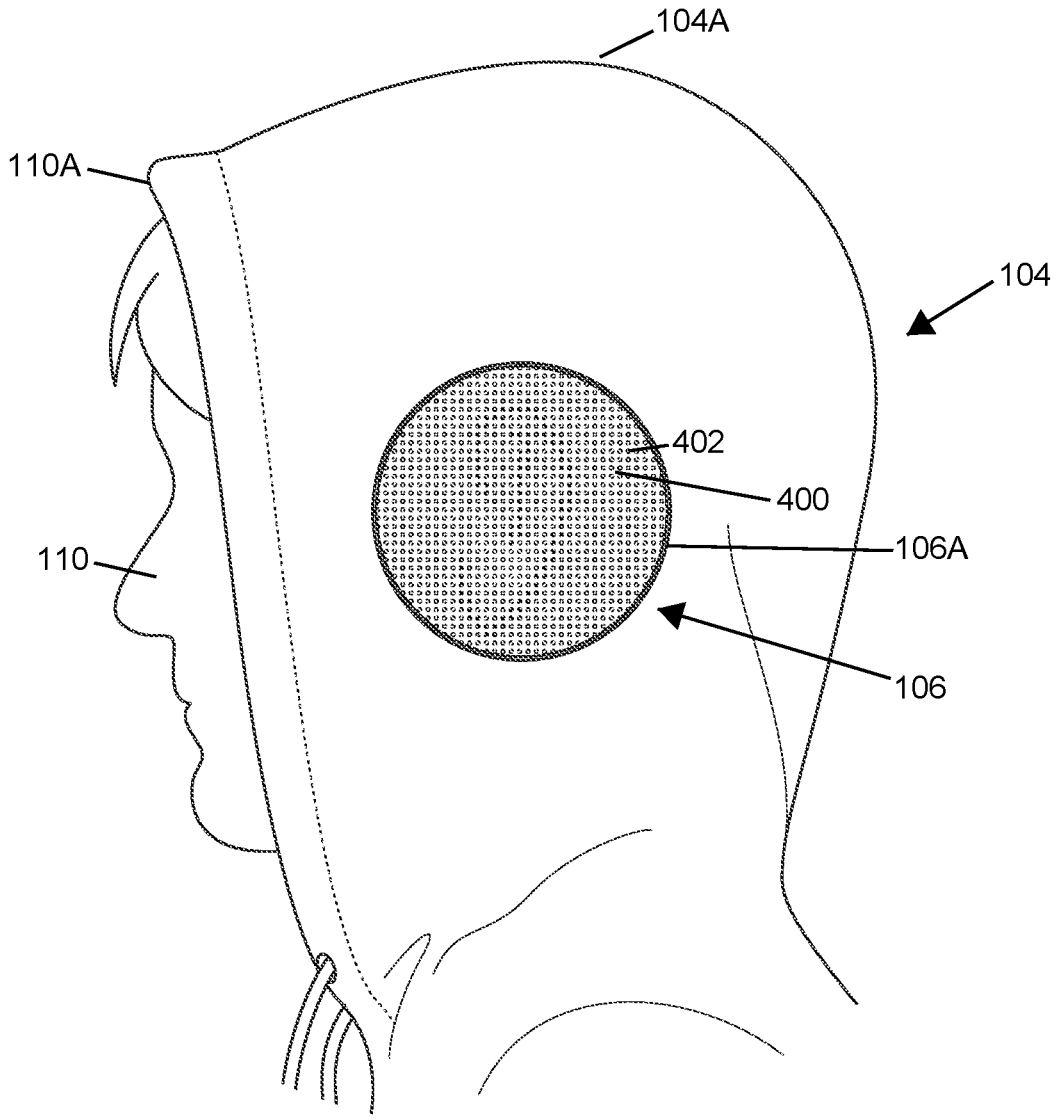
FIG. 4 is another side view illustration of a hooded article of clothing in accordance with the current disclosure.
Figure 5:
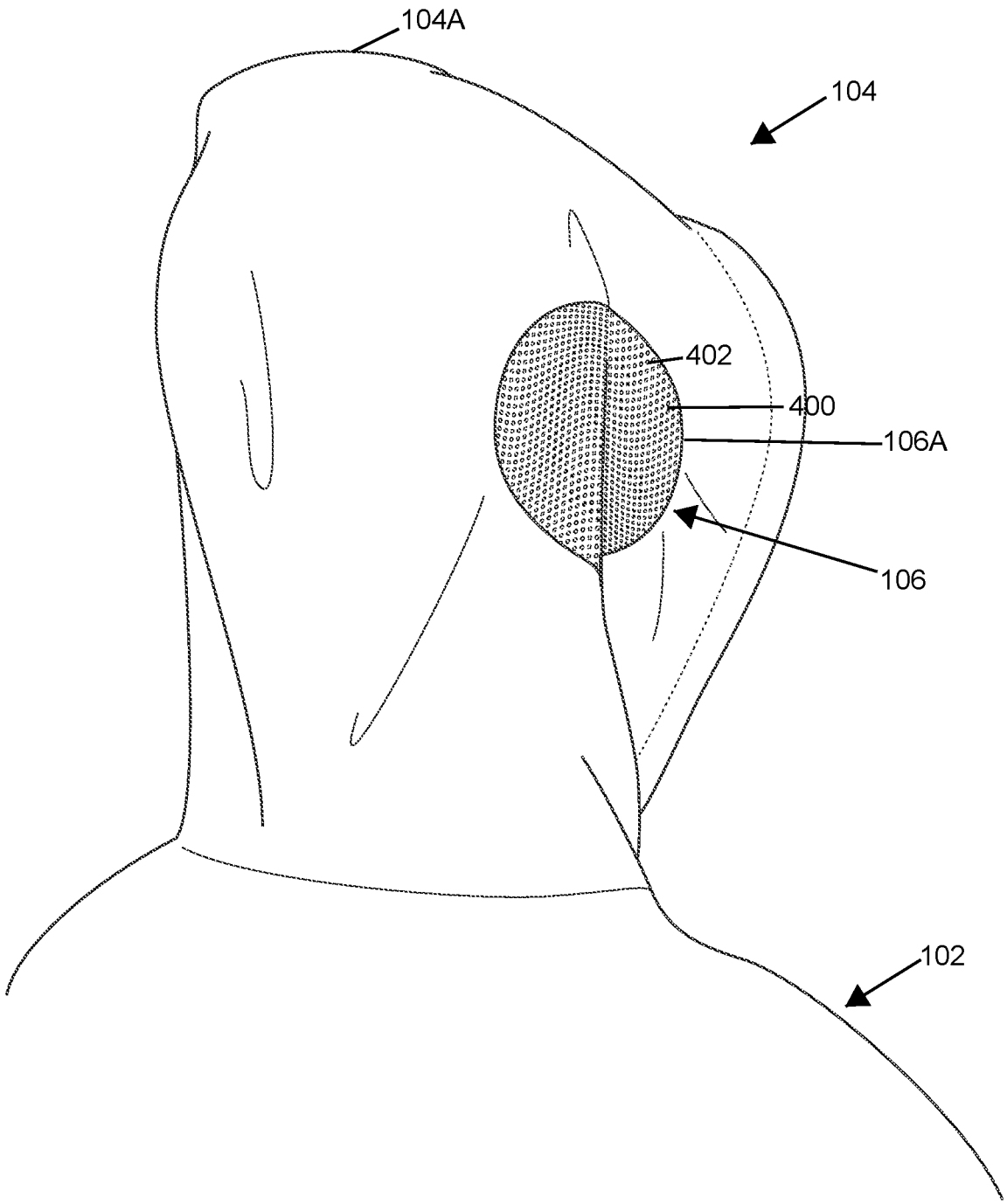
FIG. 5 is rear view illustration of a hooded article of clothing in accordance with the current disclosure.

With reference to FIGS. 4 and 5, an aperture covering 400 may be fixedly or detachably positioned over, behind, or within each of the headphone apertures 106, 108 and include a flexible material that is capable of substantially conforming to the contours of the user's ear and thereby improve the sealing connection between the user's ear and a headphone earpiece 112A, 112B. In some embodiments, the aperture covering 400 may include one or more plies of flexible material that are sewn into or over the apertures 106, 108. For example, the hood 104 may include two layers of material: an inner lining material and an outer hood material forming adjacent layers. The aperture covering 400 may be affixed (e.g., sewn, glued, etc.) between the inner lining material and the outer hood material such that the aperture covering 400 covers the hole in the panels defined by the headphone apertures 106, 108. The hood 104 may also include a single layer of material. In these embodiments, aperture coverings 400 may be sewn over or under the headphone apertures 106, 108 on the single layer of the hood 104. The outer edge 106A, 108A of the aperture coverings 400 may be a sewn hem to affix the aperture covering 400 between the adjacent layers (i.e., the inner lining material and the outer hood material) of the hood 104 over the apertures 106, 108 or over or on the single hood layer. In further embodiments, the aperture covering 400 may include one or more plies of flexible material that are removable from the headphone apertures 106, 108. For example, the apertures 106, 108 may be configured to receive the aperture covering 400 and the aperture covering 400 may be fixed temporarily over the apertures 106, 108 like a patch using hook-and-pile, button, or other temporary fasteners. In this temporary configuration, the aperture covering 400 may be affixed over or under the hood material such that the aperture covering 400 covers the hole. The outer edge 106A, 108A of the aperture coverings 400 may be temporarily affixed to the hood 104 over the apertures 106, 108 or over or on the hood. In use, the temporarily-affixed aperture covering 400 may be removed when the hood is used with headphones, then affixed when not used with headphones and more heat retention by the hood is desired. The temporarily-affixed aperture covering 400 may be completely removable or may be anchored to the hood at some points along the periphery of the covering, acting as a flap.

One or more of the plies of the aperture covering 400 may include a mesh-like, fabric material with a plurality of perforations or holes 402 to permit sound to flow from the headphone earpieces to a user's ears when worn on the outside of the hood portion 104. In use, tension from a headband of the headphones 112 may urge the headphone earpieces 112A, 112B and the aperture covering 400 toward the user's ear such that the covering 400 conforms to the outer contours of the user's ear and is sealingly positioned or "sandwiched" between a headphone earpiece 112A, 112B and the user's ear. Each of the plurality of holes 402 may be shaped and/or positioned to optimize sound translation or sound canceling from the headphones to the user's ear. In some embodiments, the holes 402 may be uniformly or variously oval-shaped, diamond-shaped, football-shaped, circular, and any other shape that optimizes sound translation or sound canceling for the user. Likewise, in some embodiments, the aperture covering 400 may include a diffuser or other sound-enhancing element or sound-canceling element. For example, the diffuser or other sound-enhancing or sound-canceling element may be the aperture covering 400 itself or may be sandwiched between two plies of flexible material to optimize the function of the element. In embodiments including multiple plies of material in the aperture coverings 400, the plies may be uniformly stacked within the opening such that some or all of the plurality of holes 402 for each ply are aligned. In other embodiments with multiple plies, each ply may be rotated within its corresponding aperture 400 such that the holes 402 are misaligned. Various configurations and alignments of the aperture coverings 400 and aperture holes 402 may optimize one or more of sound translation, sound canceling, and heat retention for the hood portion 106.

Figure 6:
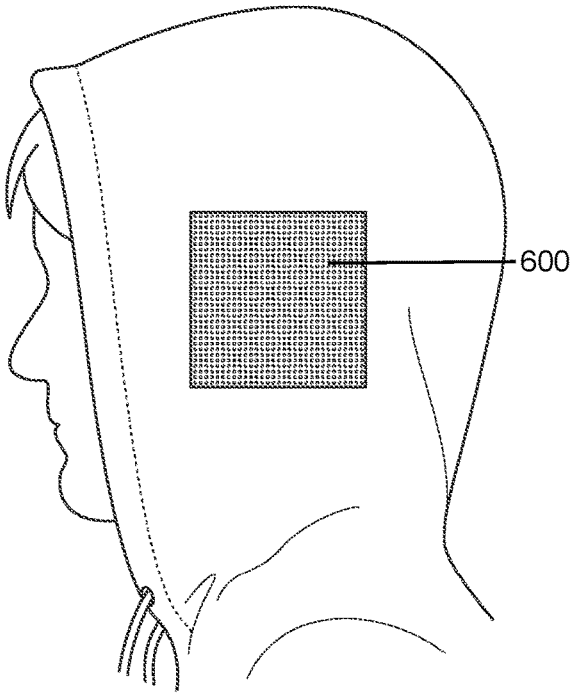
FIG. 6, FIG. 7, and FIG. 8 are side view illustrations of a hooded article of clothing in accordance with the current disclosure including decorative elements.
Figure 7:
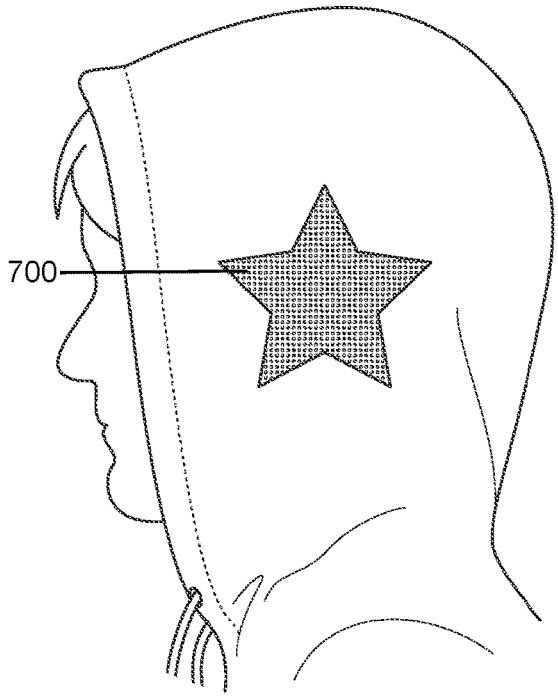
Figure 8:
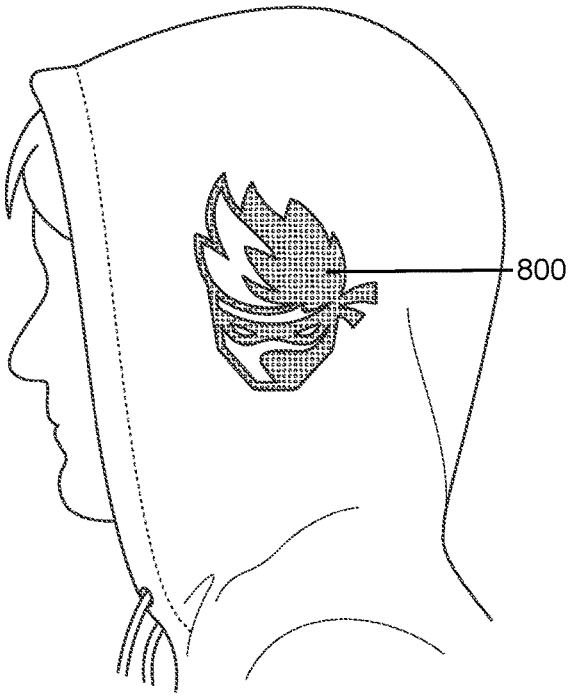

With reference to FIGS. 6, 7, and 8, the aperture coverings 600, 700, and 800, respectively, may also be shaped to accommodate various design elements in addition to or rather than the shape of the headphone earpieces. For example, the aperture covering 600 may be square, the aperture covering 700 may be star-shaped, and the aperture covering 800 may be shaped as a logo or any other shape to accommodate a design choice of the user. Each of the aperture coverings 600, 700, and 800 may include the functional elements of the embodiments described herein as well as these design elements.

Thus, a hooded garment may include integrated headphone apertures to improve the flow of sound from headphones worn over the hood to the user's ears. A portion of mesh fabric with a plurality of perforations may replace a portion of hood fabric that is positioned over the user's ears when the hood is "up" or substantially covers the user's head. In some embodiments, the perforated fabric portion may be one or more plies of fabric having perforations of uniform or varying size. The fabric plies and/or perforations within the aperture covering material may be positioned over the user's ears in various configurations to optimize both sound translation to the user's ears and heat retention for user comfort.

As used herein any reference to "some embodiments" or "an embodiment" or "teaching" or "disclosure" means that a particular element, feature, structure, or characteristic described in connection with the embodiment is included in at least one embodiment. The appearances of the phrase "in some embodiments" or "teachings" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical contact. The term "coupled," however, may also mean that two or more elements are not in direct contact with each other, but yet still co-operate or interact with each other. The embodiments are not limited in this context.

Further, the figures depict preferred embodiments for purposes of illustration only. One skilled in the art will readily recognize from the following discussion that alternative embodiments of the structures and methods illustrated herein may be employed without departing from the principles described herein Upon reading this disclosure, those of skill in the art will appreciate still additional alternative structural and functional designs for the systems and methods described herein through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the systems and methods disclosed herein without departing from the spirit and scope defined in any appended claims.

The invention claimed is:

1. An article of clothing comprising:

a hood configured to extend upward from a neck region, the hood including a crown and a face opening area, the face opening area defined by a first side panel and a second side panel, the first side panel opposed to the second side panel, the first and second side panels each including an inner lining material and an outer shell material extending upward from the neck region and joining at the crown;

a first headphone aperture formed through the inner lining material and the outer shell material on the first side panel to cover a first outer ear portion of a user when the hood covers a user's head;

a second headphone aperture formed through the inner lining material and the outer shell material on the second side panel to cover a second outer ear portion of the user when the hood covers the user's head;

a first aperture covering within the first headphone aperture including at least three first adjacent plies including a first diffuser between a first aperture covering first ply and a first aperture covering second ply, wherein the first aperture covering first ply and the first aperture covering second ply each include a first portion of mesh fabric having a plurality of perforations, and the at least three first adjacent plies are affixed between the inner lining material and the outer shell material; and a second aperture covering within the second headphone aperture including at least three second adjacent plies including a second diffuser between a second aperture covering first ply and a second aperture covering second ply, wherein the second aperture covering first ply and the second aperture covering second ply each include a second portion of mesh fabric having a plurality of perforations, and the at least three second adjacent plies are affixed between the inner lining material and the outer shell material;

wherein the plurality of perforations of the first aperture covering first ply and the first aperture covering second ply are misaligned in relation to each other and the plurality of perforations of the second aperture covering first ply and the second aperture covering second ply are misaligned in relation to each other.

2. The article of claim 1, wherein the inner lining material and the outer shell material form adjacent layers of the hood.

3. The article of claim 1, wherein the hood is selectively detachable from the neck region.

4. An article of clothing, comprising:

a shirt having a hood extending upward from a neck region to a crown, the hood having an inner lining material and an outer shell material, forming adjacent layers, and a face opening area defined by a hem of the adjacent layers;

a first headphone aperture and a second headphone aperture both extending through the inner lining material and the outer shell material on opposing sides of the hood; and a first aperture covering within the first headphone aperture and a second aperture covering within the second headphone aperture, the first aperture covering and the second aperture covering including at least three adjacent plies, the at least three adjacent plies for the first aperture covering including a first diffuser between a first aperture covering first ply including a plurality of perforations and a first aperture covering second ply including a plurality of perforations, and the at least three adjacent plies for the second aperture covering including a second diffuser between a second aperture covering first ply including a plurality of perforations and a second aperture covering second ply including a plurality of perforations;

wherein the plurality of perforations of the first aperture covering first ply and the first aperture covering second ply are misaligned in relation to each other, the plurality of perforations of the second aperture covering first ply and the second aperture covering second ply are misaligned in relation to each other, and when the hood is configured to cover a user's head, the first headphone aperture is configured to cover at least a portion of a first ear of a user and the second headphone aperture is configured to cover at least a portion a second ear of the user.

5. The article of claim 4, wherein the first aperture covering and the second aperture covering are affixed between the inner lining material and the outer shell material.

6. The article of claim 4, wherein the hood is selectively detachable from the shirt.

7. The article of claim 4, wherein the first aperture covering within the first headphone aperture is sewn into or over the first headphone aperture and the second aperture covering within the second headphone aperture is sewn into or over the second headphone aperture.

* * * * *